US005823156A

United States Patent [19]

Thiel et al.

[11] Patent Number: 5,823,156

[45] Date of Patent: Oct. 20, 1998

[54] DUAL BORE INTAKE MANIFOLD

[75] Inventors: Timothy S. Thiel, Plymouth; Victor Van Dyke, Sheboygan, both of Wis.

[73] Assignee: Kohler Co., Kohler, Wis.

[21] Appl. No.: 833,757

[22] Filed: Apr. 9, 1997

[51] Int. Cl.[6] ..... F02M 35/10

[52] U.S. Cl. ..... 123/184.31; 123/184.61

[58] Field of Search ..... 123/184.61, 184.21, 123/184.31, 184.32, 184.39, 184.46

[56] References Cited

U.S. PATENT DOCUMENTS

| | | | |
|---|---|---|---|
| 4,116,172 | 9/1978 | Lohr et al. | 123/184.34 |
| 4,741,295 | 5/1988 | Hosoya et al. | 123/184.31 |
| 4,805,564 | 2/1989 | Hudson, Jr. | 123/184.61 |
| 4,945,865 | 8/1990 | Lee | 123/184.43 |
| 5,016,578 | 5/1991 | Ogawa et al. | 123/184.61 |
| 5,081,962 | 1/1992 | Kurokawa et al. | 123/184.36 |
| 5,109,811 | 5/1992 | Tanaka et al. | 123/184.36 |
| 5,123,382 | 6/1992 | Aoki et al. | 123/184.36 |
| 5,125,369 | 6/1992 | Hitomi et al. | 123/184.36 |
| 5,170,754 | 12/1992 | Urabe | 123/184.31 |
| 5,263,440 | 11/1993 | Bodnar et al. | 123/184.31 |
| 5,275,135 | 1/1994 | Clemens et al. | 123/184.21 |
| 5,477,819 | 12/1995 | Kopec | 123/184.61 |
| 5,544,629 | 8/1996 | Ohata et al. | 123/184.36 |
| 5,636,605 | 6/1997 | Nomizo et al. | 123/184.61 |

*Primary Examiner*—David A. Okonsky
*Attorney, Agent, or Firm*—Quarles & Brady

[57] ABSTRACT

A dual bore intake manifold for an internal combustion engine is disclosed which has a simplified construction and provides improved engine performance. A one-piece manifold and throttle housing is disclosed resulting in reduced production costs. The one-piece manifold and throttle housing affords easy attachment to an engine as it can be mounted in the same manner as a single bore manifold.

5 Claims, 2 Drawing Sheets

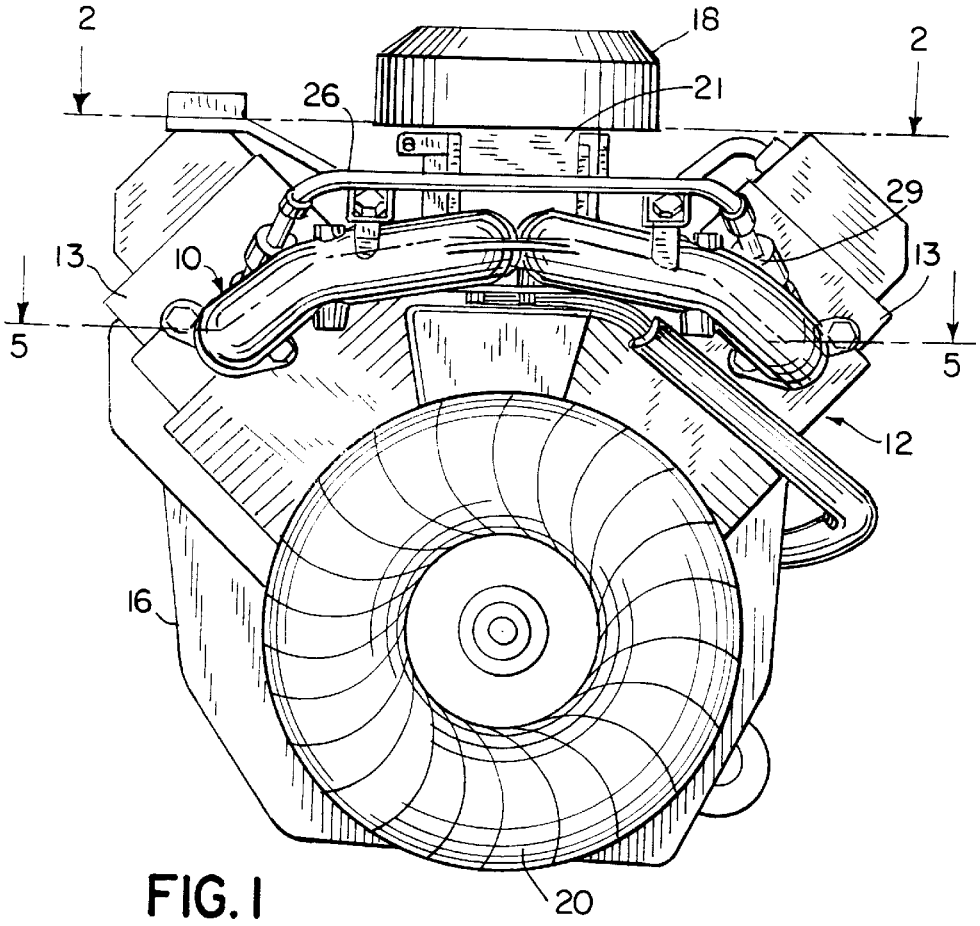
FIG. 1
FIG. 2
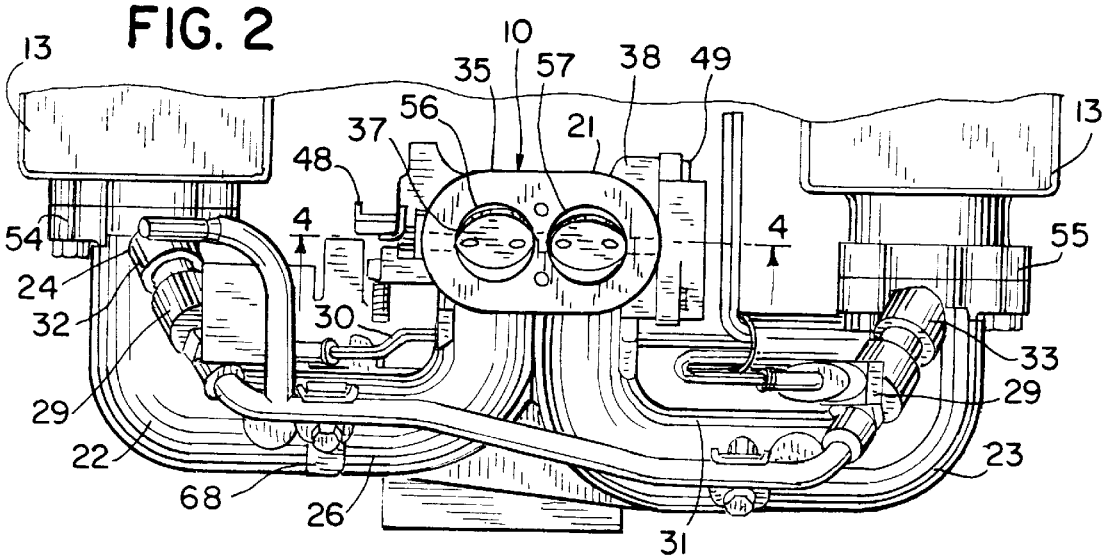

FIG. 3
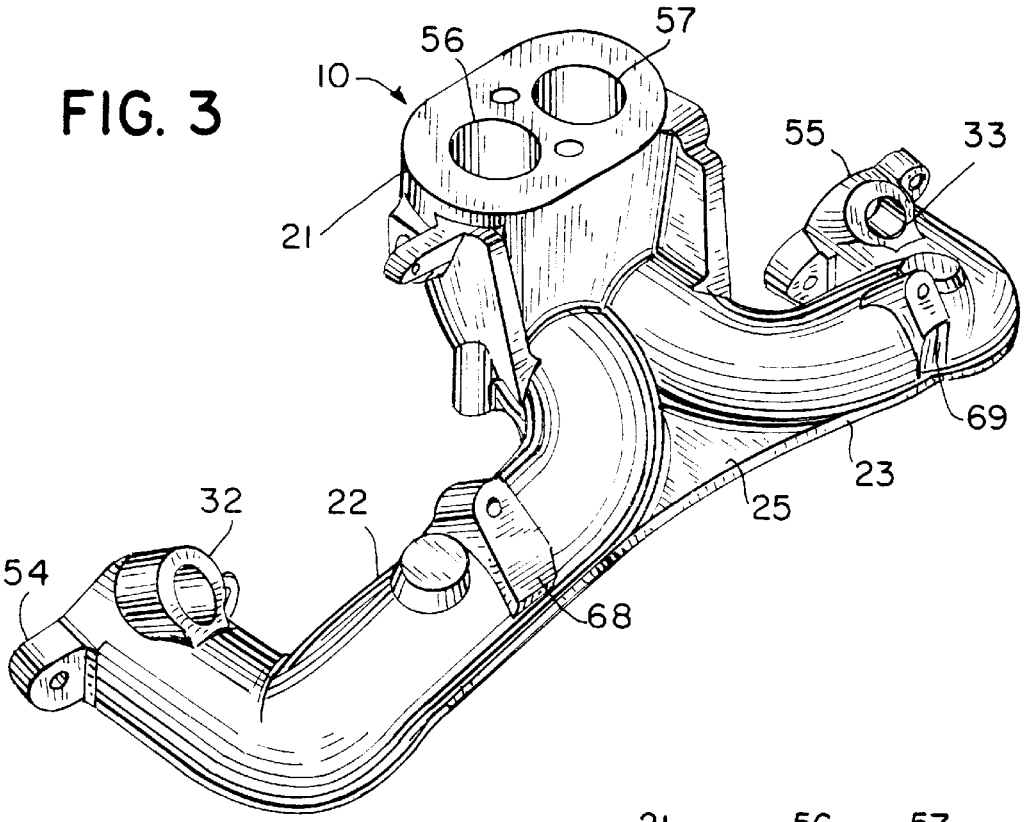
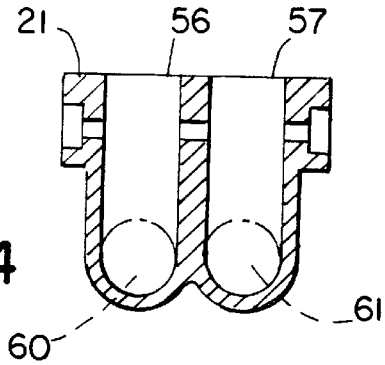
FIG. 4
FIG. 5
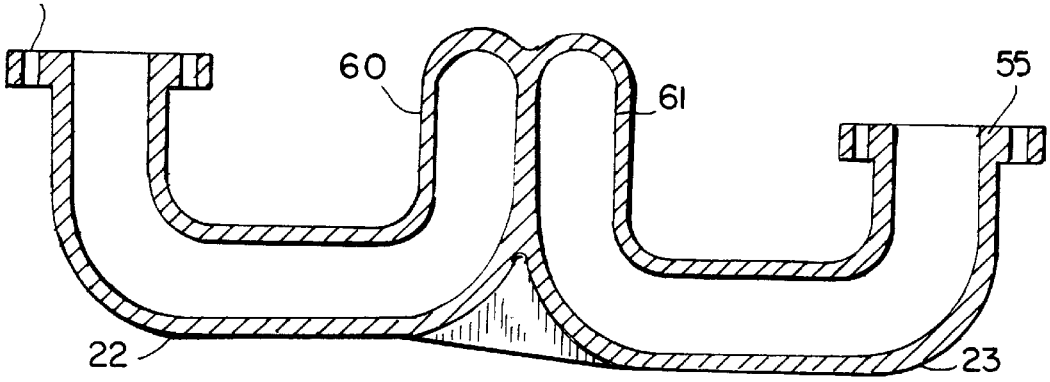

DUAL BORE INTAKE MANIFOLD

CROSS REFERENCE TO RELATED APPLICATIONS (None)

FEDERALLY SPONSORED RESEARCH (Not Applicable)

FIELD OF THE INVENTION

This invention relates to internal combustion engines and intake manifolds. More particularly, the invention relates to a one-piece air intake manifold having a throttle control housing and a fuel injection port.

BACKGROUND OF THE INVENTION

Commonly used intake manifolds employ a single bore that branches to each cylinder of an internal combustion engine. Because of the common section that cylinders use to intake the combustion mixture, the single bore that both cylinders use in a two cylinder engine to intake the combustion mixture creates uneven distribution of a combustion mixture to each cylinder. The inertia of the combustible mixture in the common portion of the normal bore manifold combined with a 90 degree V-ee engine valve timing yields an undesired, uneven distribution among the two cylinders. The result is that one of the cylinders is starved of the combustible mixture whereas the other is favored. This situation is present in all multicylinder engines that have a common portion of the intake manifold.

It is known to provide a one-piece dual bore intake manifold for an internal combustion engine. It is available from Briggs & Stratton Company. However, it is employed in conjunction with a carburetor and does not have the capability of separate air and fuel introduction, as well as a throttling of the air. Single piece manifolds with throttle bodies are also known but these have only a single throttle and do not provide for separate conduits from the throttle body.

Thus, an improved intake manifold for an internal combustion engine is desired.

SUMMARY OF THE INVENTION

In one embodiment, the present invention includes a one-piece dual bore intake manifold with first and second conduit members having first and second ends. The first and second conduit members are constructed and arranged to provide independent flow paths from the first ends to the second ends. A throttle control housing having two separate passages is connected to each of the first ends for separate communication with the first and second conduit members. The first and second conduit members and the throttle control housing are constructed as a one-piece unit. The second ends of the conduit members are adapted to be connected to engine cylinders.

In a preferred embodiment, fuel injection ports are disposed in the first and second conduit members adjacent the second ends thereof.

In one aspect, the second ends of the manifold are connected directly to cylinder heads of a V-ee engine.

In another aspect, the one-piece unit is a metal casting.

It is therefore an object of the present invention to provide an intake manifold which improves combustion efficiency in an internal combustion engine.

It is another object of the present invention to provide an intake manifold which is simple in its construction yet affords even distribution of a combustible mixture to each cylinder of an internal combustion engine.

It is yet another object of the present invention to provide an intake manifold of the foregoing type which affords separate intake of fuel and air.

It is still another object of the invention to provide an intake manifold of the foregoing type which is easily assembled and connected to a V-ee engine.

It is yet another object of the present invention to provide an intake manifold of the foregoing type which results in a reduction of manufacturing costs.

The foregoing and other objects and advantages of the invention will appear from the following description. In the description, reference is made to the accompanying drawings in which there is shown by way of illustration a preferred embodiment of the invention. Such embodiment does not represent the full scope of the invention. Reference should therefore be made to the claims for interpreting the scope of the present invention.

BRIEF DESCRIPTION OF THE DRAWINGS

FIG. 1 is a front view showing an engine illustrating the dual bore manifold connected thereto;

FIG. 2 is a partial top view taken along line 2—2 of FIG. 1;

FIG. 3 is a top perspective view of the dual bore intake manifold;

FIG. 4 is a sectional view taken along line 4—4 of FIG. 2; and

FIG. 5 is a sectional view taken along line 5—5 of FIG. 1.

DETAILED DESCRIPTION

Referring to FIG. 1, the dual bore intake manifold, generally 10, is shown in conjunction with a Vee engine 12 composed of cylinders 13, the usual crankcase 16 and a cooling fan 20. An air intake filter 18 is positioned at the top of the throttle housing 21 of the dual bore intake manifold.

Referring specifically to FIGS. 2 and 3, the dual bore intake manifold 10 has two conduit members 22 and 23 extending from the throttle housing 21 and joined at a common junction 25. A fuel inlet 24 is connected to a fuel intake rail 26 which in turn is connected to the fuel injectors 29. The fuel injectors 29 are connected to fuel injection ports 32 and 33 of the conduit members 22 and 23, respectively. Control wires 30 and 31 are connected to the fuel injectors 29 for controlling fuel injection by means of the usual control processing unit (not shown). A throttle 35 having two throttle plates 37 and 38 is operatively connected in the throttle housing 21 and controls air intake into the passages 56 and 57. A throttle linkage 48 controls the throttle 35 which position is sensed by the throttle position sensor 49.

Referring specifically to FIG. 3, there are bosses 68 and 69 which provide connection for the fuel intake rail 26 as seen in FIG. 2.

As seen in FIGS. 4 and 5, the conduit members 22 and 23 have the passages 60 and 61, respectively, which communicate separately with the passages 56 and 57 in the throttle housing 21. Numerals 54 and 55 indicate the connecting ends of the manifold to the engine 12 and ease of attachment.

An important feature of this invention is the separate passages for the air to the cylinders 13 from the throttle housing 21 as provided by the conduit members 22 and 23. As stated above, this affords even distribution of a combustible mixture to each cylinder. This separate introduction of air in combination with the fuel injection at the ends of the conduits affords good cold start performance as there is improved volumetric efficiency and lack of hydraulic losses as when the fuel is injected farther upstream.

Another important feature is the one-piece construction of the throttle housing and the conduits. This affords cost reduction in the casting process and the use of fewer parts as where the standard carburetor would be employed.

The preferred casting metal is aluminum. However, other casting materials could be employed such as other metals and engineered materials.

It will be apparent to those skilled in the art that other variations besides these can be made in the preferred embodiment described and without departing from the spirit of the invention. The claims should therefore be looked at to judge the full scope of the invention.

What is claimed is:

1. A one-piece dual bore intake manifold comprising:

first and second conduit members having first and second ends, the first and second conduit members constructed and arranged to provide independent flow paths from the first ends to the second ends;

a throttle control housing having two separate passages connected to each of the first ends for separate communication with the first and second conduit members, the first and second conduit members and the throttle control housing constructed as a one-piece unit, and the second ends of said conduit members adapted to be connected to engine cylinders.

2. The intake manifold as defined in claim 1 further including fuel injection ports disposed in the first and second conduit members.

3. The intake manifold as defined in claim 2 wherein the fuel injection ports are placed adjacent the second ends of the conduit members.

4. The intake manifold as defined in claim 3 wherein the second ends of said manifold are connected directly to cylinder heads of a V-ee engine.

5. The intake manifold as defined in claim 1, wherein the one-piece dual bore intake manifold is a metal casting.

* * * * *